US005244138A

United States Patent [19]

Blanding et al.

[11] Patent Number: 5,244,138

[45] Date of Patent: Sep. 14, 1993

[54] ROLLER FOR SUPPORTING A WEB HAVING AXIALLY SLIDABLE STAVES

[75] Inventors: Douglass L. Blanding, Rochester; Ronald R. Firth, Fairport, both of N.Y.

[73] Assignee: Eastman Kodak Company, Rochester, N.Y.

[21] Appl. No.: 785,955

[22] Filed: Oct. 31, 1991

[51] Int. Cl.[5] ..... B65H 23/038; B65H 20/02

[52] U.S. Cl. ..... 226/174; 226/190; 226/15; 492/36; 492/26

[58] Field of Search ..... 226/174, 190, 194, 15, 226/19; 29/895.213, 895.22, 895.23, 893.3, 118, 119, 121.5, 126

[56] References Cited

U.S. PATENT DOCUMENTS

| | | | |
|---|---|---|---|
| 678,121 | 7/1901 | Lewis | 226/190 |
| 1,111,333 | 9/1914 | Voigt et al. | 226/190 X |
| 2,109,451 | 3/1938 | Loomis et al. | 29/119 |
| 3,052,395 | 9/1962 | Scott | 226/190 |
| 3,060,545 | 10/1962 | Theil et al. | 29/121.5 X |
| 3,095,131 | 6/1963 | Robertson et al. | 226/190 |
| 3,295,736 | 1/1967 | Leimer et al. | 226/190 |
| 3,344,969 | 10/1967 | Collinge et al. | 226/190 |
| 3,727,816 | 4/1973 | Meneo | 226/19 |
| 3,784,076 | 1/1974 | Avery et al. | 226/179 |
| 3,994,380 | 11/1976 | Hope et al. | 226/190 X |
| 4,944,089 | 7/1990 | Flamig et al. | 29/895.22 |

*Primary Examiner*—Daniel P. Stodola
*Assistant Examiner*—Paul T. Bowen
*Attorney, Agent, or Firm*—Robert L. Randall

[57] ABSTRACT

A roller over which advances a web of material such as paper, photographic film or the like includes a plurality of staves organized in first and second arrays with the staves of the first array alternating with the staves of the second array to provide surfaces for supporting the web. The staves are each individually mounted on the roller by separate spring legs which center the staves. Flanges are located at the ends of the roller to position the web laterally. When the web obliquely approaches the axis of the roller so as to helically advance thereover, the staves sequentially and independently shift axially due to engagement with the helically advancing web. After the web leaves the roller, the stave that the web was most recently supported by returns under the bias of the spring legs to its central, unbiased position. In this way, damage to the edges of the web, due to engagement with the flanges, is minimized.

9 Claims, 3 Drawing Sheets

ROLLER FOR SUPPORTING A WEB HAVING AXIALLY SLIDABLE STAVES

DESCRIPTION

1. Field of the Invention

The instant invention relates to rollers for supporting advancing webs. More particularly, the instant invention relates to rollers with end flanges, the rollers being configured to minimize the risk of damage to webs due to engagement of webs with the end flanges.

2. Background Art

Flanged rollers are often used to convey webbed materials during manufacture thereof and in devices such as laser printers, image reproduction machines, photographic film processing machines and the like. A frequently experienced difficulty occurs when a web becomes wrapped on a flanged roller at a slightly helical angle causing the web to move axially so that one of the web edges advances toward one of the flanges. The purpose of the flanges is to arrest this lateral migration of the web. Unfortunately, the surface of the roller may engage the web with enough frictional force to jam one edge of the web against one of the flanges tearing, buckling or otherwise disturbing or damaging the edge. If the coefficient of friction between the web and roller is sufficiently high, a web edge may climb the flange, instead of merely abutting the flange. This is especially the case if the flange is bevelled in an attempt to minimize damage which might be caused to the edge of the web by an abrupt juncture between the roller and flange. If an attempt is made to minimize the problem by making the web more taut, the problem can be made worse because by increasing tension in the web, the frictional force between the web and roller increases.

U.S. Pat. No. 3,052,395 to Scott is of interest with respect to the background art in that the purpose of the patent is to prevent a roller from imparting axial forces to a web. This is accomplished by forming the web supporting surface of the roller with slidably supported staves which are spring biased in one direction. However, this patent does not specifically address the problem of webs being damaged by flanges, nor does it disclose an arrangement which allows the individual staves to move in either direction against the bias of the springs so as to prevent the web from damaging itself upon engaging either flange.

SUMMARY OF THE INVENTION

It is an object of the instant invention to provide a new and improved segmented roller which minimizes the risk of damage to a web advancing over the roller caused by the edge of the web engaging flanges disposed at the ends of the roller.

Upon further study of the specification and appended claims, further objects and advantages of this invention will become apparent to those skilled in the art.

In view of the above object, and other objects, the instant invention contemplates a roller which rotates about an axis as a web of material is transported thereover. The roller comprises a plurality of axially extending staves for providing a plurality of independent support surfaces for the web. The staves are resiliently supported to move freely in the axial direction under the influence of the web, but are restored to their initial position by the springs during the time the staves are not in contact with the web.

In accordance with a more specific embodiment of the invention, the roller has a first array of staves having first and second ends with first surface increments for supporting the web and a second array of staves having first and second ends with second surface increments for supporting the web. The staves are supported adjacent the ends thereof by individual resilient constraints and can move only in an axial direction with respect to the roller.

DESCRIPTION OF THE PREFERRED EMBODIMENTS

Figure 1:
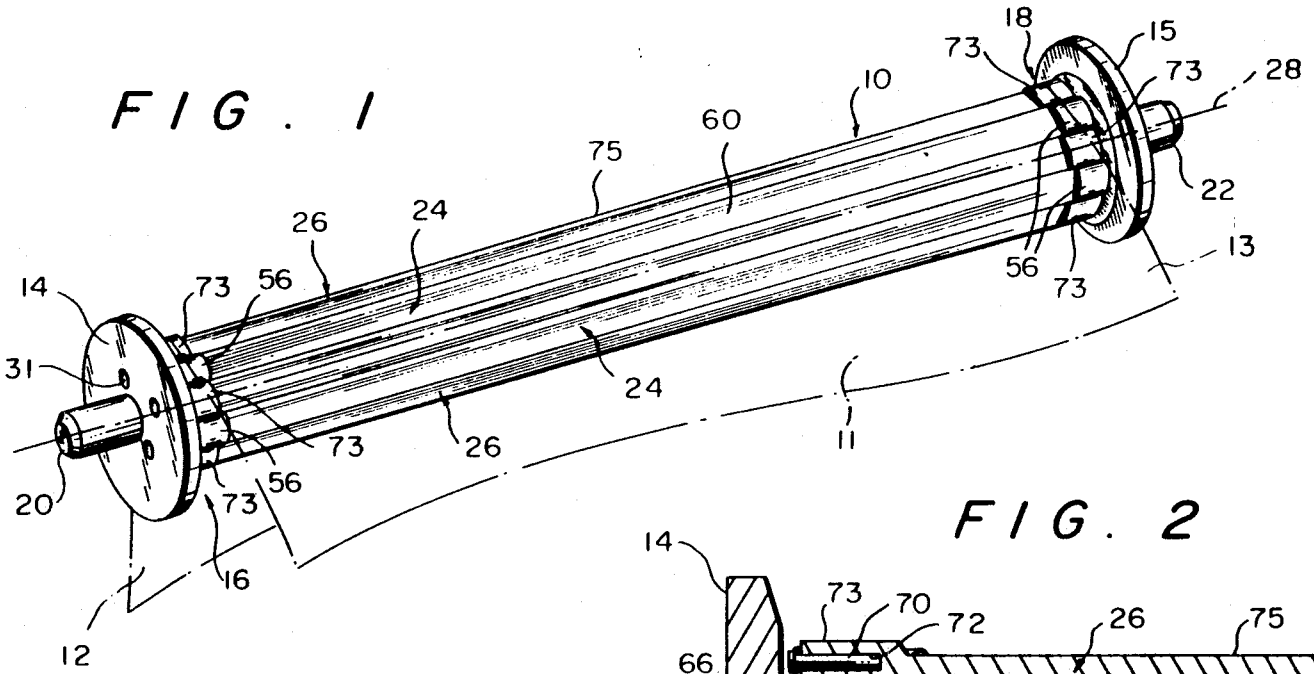
FIG. 1 is a perspective view of a roller configured in accordance with the principles of the instant invention with a web of material in engagement therewith.

Referring now to FIG. 1, there is shown a roller, designated generally by the numeral 10, configured in accordance with the principles of the instant invention to support a web of material 11. Roller 10 is useful in machines which advance webs of material, such as webs of paper in laser printers and the like, webs of photographic film in film processing machinery or webs of plastic wrapping film. It is emphasized that the web 11 may be comprised of any material being advanced over the roller 10 for any purpose.

Roller 10 minimizes the force with which the side edges 12 and 13 of the web 11 will come into contact with first and second end flanges 14 and 15, respectively, disposed at first and second ends, designated generally by the numerals 16 and 18, respectively of the roller 10. Outbound of the first and second end flanges 14 and 15 are first and second mounting shafts 20 and 22, respectively, which are mounted in bearings (not shown) to support the roller 10.

The roller 10 includes first staves, designated generally by the numerals 24, and second staves, designated generally by the numerals 26. As will be explained hereinafter, the first staves 24 and second staves 26 are arranged in alternate first and second arrays between the first and second flanges 14 and 15 with a first stave 24 positioned between each pair of second staves 26 and a second stave 26 positioned between each pair of first staves 24. In accordance with the principles of the instant invention, the first and second staves 24 and 26 are resiliently restrained to move linearly only in the direction of the longitudinal axis 28 of the roller 10. The staves 24 and 26 are constrained with respect to the other five degrees of freedom.

Figure 4:
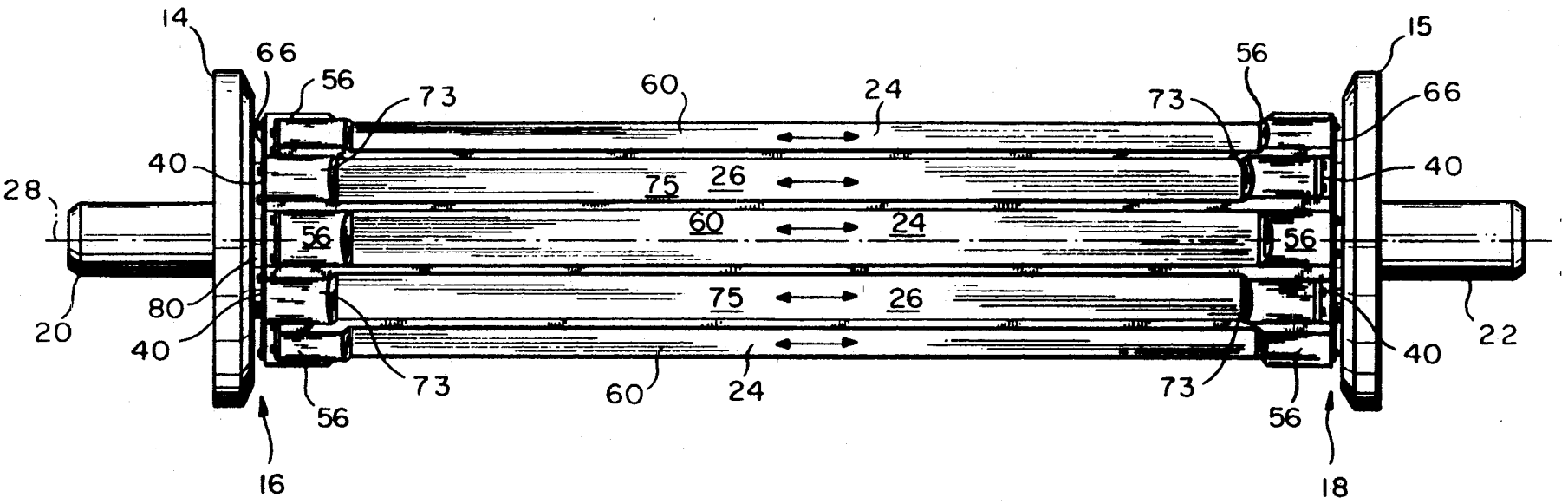
FIG. 4 is a side view of the roller of the instant invention.

As is seen in FIGS. 1 and 4, the first and second staves 24 and 26 are the same length and are of an identical construction. The first array of staves, formed by the staves 24, is spaced a greater distance from the first flange 14 then the second array of staves, formed by the staves 26, while being spaced closer to the second flange 15 than the second array of staves. Conversely, the staves 26 of the second array are spaced closer to the first flange 14 and further from the second flange 15 than the staves 24 of the first array.

Figure 2:
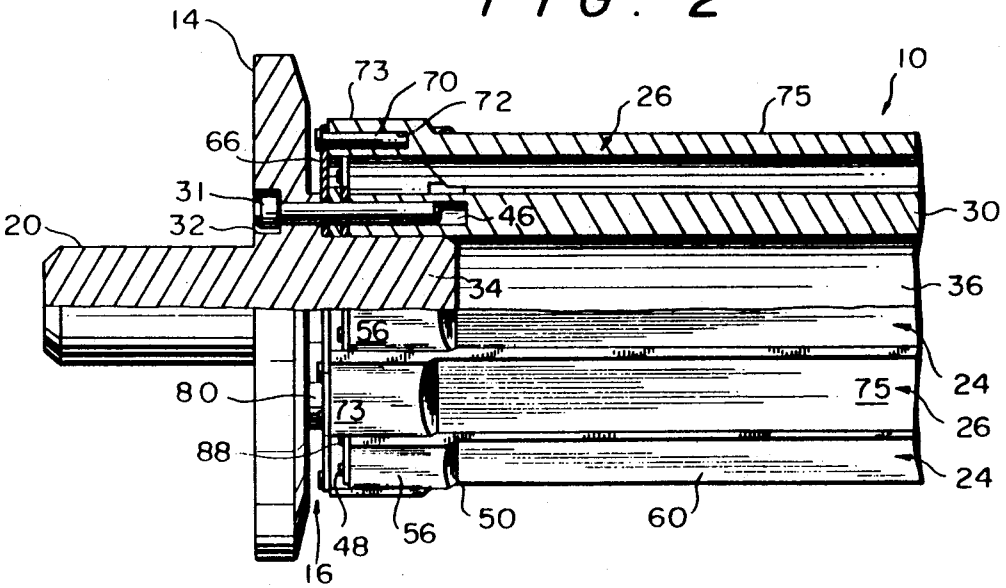
FIG. 2 is an enlarged side view, partially in elevation, showing one end of the roller of FIG. 1.
Figure 3:
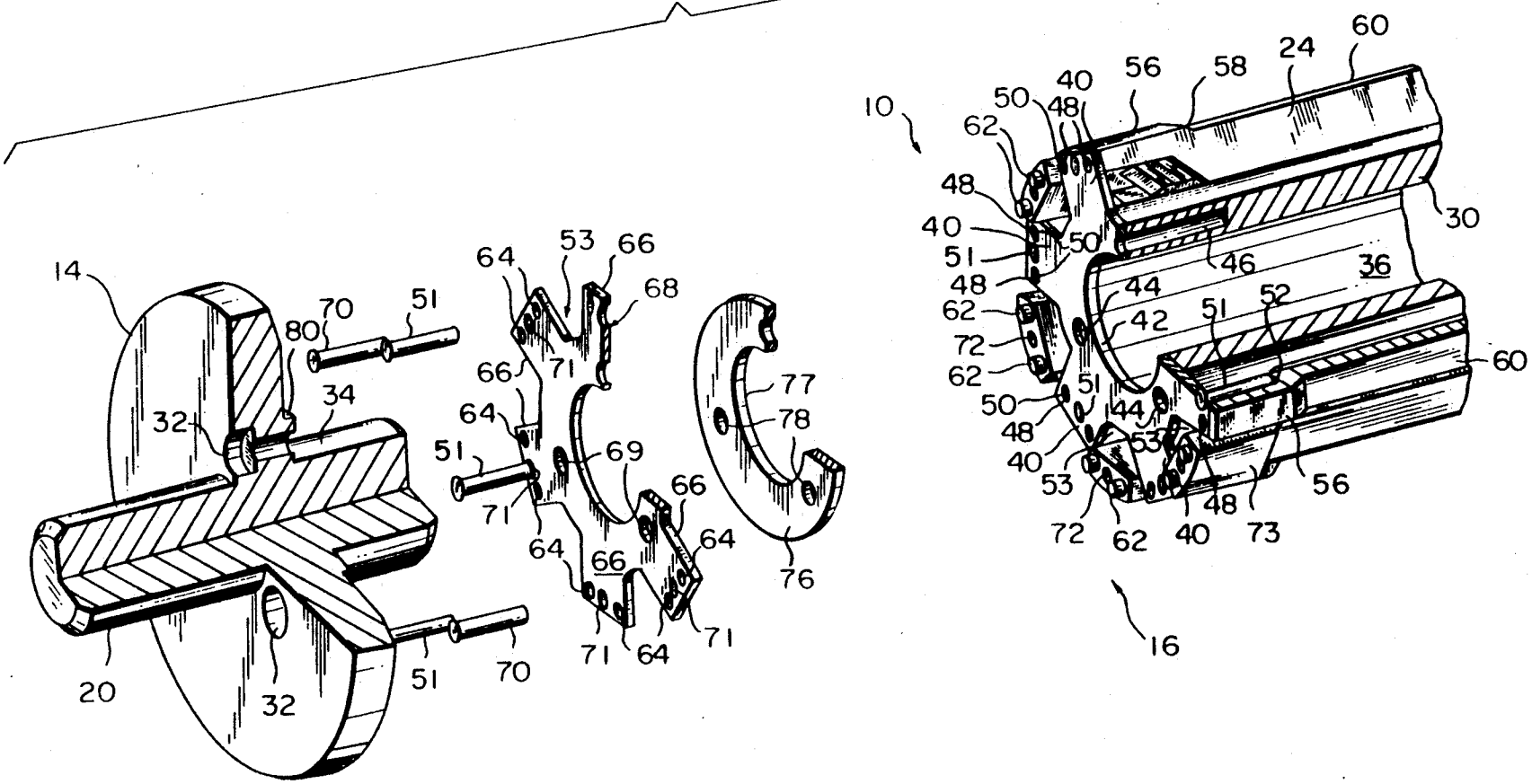
FIG. 3 is an exploded, perspective view, partially cut away, illustrating the component parts of end of the roller of FIG. 2.

Referring now more specifically to FIGS. 2 and 3, where the first end 16 of the roller 10 is shown, the roller 10 includes an internal hollow shaft 30 which is coupled to the first flange 14 and the second flange 15 (FIGS. 1 and 4) by four assembly screws 31 which pass through bores 32 in each of the flanges 14 and 15. The first end flange 14 is preferably unitary with the mounting shaft 20 and includes a shank portion 34 which extends into a bore 36 of the hollow shaft 30 so as to provide a rigid, integrated assembly.

As is best seen in FIG. 3, the first staves 24 are secured by screws, or other elongated fasteners such as rivets, to an individual spring leg 40 cantilevered from a first spring retainer, designated generally by the numeral 42. The resilient spring retainer 42 is made from a material such as spring steel or perhaps a resilient resin and has four holes 44 therein which are aligned with bores 46 in hollow shaft 30 so that the assembly screws 31 (FIG. 2) fix the first spring retainer directly to the hollow shaft when assembling the first end flange 14 thereto. In order to prevent the first staves 24 from rotating, two studs 48 project from the ends 49 of the first staves and are received through holes 50 in the associated spring legs 40. A single screw 51 (FIG. 3) used to secure the staves 24 to the spring legs 40 is received in bore 52 within each of the first staves.

There are six spring legs 40, each of which is separated by a space 53, used to support an array of six first staves 24 at the first end 16 of the roller 10. The first staves 24 are axially staggered with respect to the second staves 26. Each first stave 24 includes end shoulder surfaces 56 which are stepped by a beveled surface 58 from a long central land 60.

The second staves 26, which form the second array of staves, extend through the spaces 53 between the legs 40 of the first retaining spring 42 and slightly beyond the first retaining spring. Like the first staves 24, the second staves 26 each have two studs 62 extending therefrom which are received in holes 64 in individual spring legs 66. The spring legs 66 are cantilevered from a second resilient retainer, designated generally by the numeral 68, also made of spring steel or another resilient material. The second resilient retainer 68 has holes 69 therein through which the assembly screws 31 pass when securing first flange 14 to hollow shaft 30. A screw 70 passes through hole 71 in each stave 26 and is received in a bore 72 in the end of the stave to secure the stave to the spring leg 66 and to retain the studs 62 in the holes 64 so that the second staves do not twist or rotate with respect to the resilient retainer 68.

The second staves 26, each have end shoulder surfaces 73 stepped by a shoulder 74 from a long central land 75. The end shoulder surfaces 73 cooperate with the end shoulder surfaces 56 to support the web 11 adjacent the edges 12 and 13 thereof.

An annular spacer 76 is sandwiched between the first resilient retainer 42 and second resilient retainer 68 but does not extend radially beyond the roots of legs 40 and 66. The annular spacer 76 has a circular opening 77 through which the shank portion 34 of the flange 14 passes and four bores 78 through which the assembly screws 31 pass after passing through holes 69 in resilient retainer 68 and before passing through holes 44 in resilient retainer 42 to seat in the bores 46 in barrel 30.

The flange 14 further has a hub 80 adjacent its inboard surface 82 which abuts the outer surface 84 of the second resilient retainer 68 at a location inboard of the legs 66 of the second resilient retainer. Accordingly, when the end flange 14 is assembled to the hub 10 by the screws 31 being threaded in the bores 46, there is a space 86 between the inboard surface 82 of the flange 14 and the legs 66 of the resilient retainer 68. This allows the legs 66 to flex slightly in the outward direction towards the flange 14. In addition, the annular spacer 76 allows legs 66 to flex inwardly without interfering with the legs 40 while allowing the legs 40 to flex outwardly without interfering with the legs 66 due in part to the space 88 provided by the annular spacer 76.

Referring now to FIG. 4, it is seen that the second end 18 of the roller 10 is substantially identical to the first end 16 with the same reference numerals identifying identical structures. However, at the second end 18, the first staves 24 are fixed to the spring legs 66 of the second resilient retainer 68 while the second staves 26 are fixed to the spring legs 40 of the first resilient retainer 42. Consequently, the first staves 24 are axially staggered with respect to the second staves 26 thus forming the first array of staves, staves 24, and the second array of staves, staves 26.

In the illustrated embodiment, the web 11 is supported on the end shoulder surfaces 56 of staves 24 and the end shoulder surfaces 73 of staves 26, respectively which end shoulder surfaces each provide surface increments for supporting the web. The shoulder surfaces 56 and 73 are arcuate and have the same radius with respect to the central axis 28 of the roller 10. The end shoulder surfaces 56 and 73 support the web 11 in spaced relation to the elongated lands 60 and 75 of the staves 24 and 26, respectively. If the material of web 11 is photographic film or paper being used for an application such as a laser printer, it is frequently preferable that the web not touch the roller 10 except proximate the edges 12 and 13 of the web.

In operation, the spring legs 40 and 66 constrain the staves 24 and 26 in five degrees of freedom allowing each stave to move only in the direction of axis 28. Moreover, the spring legs 40 and 66 supply a small restoring force to return the staves 24 and 26 constrained thereby to a neutral, axially undeflected position prior to the staves again coming into contact with the web 11. As the roller 10 rotates there is a substantial period of time during which the individual staves 24 and 26 are not in contact with the web 11 allowing the spring legs 40 and 66 sufficient time to restore the staves 24 and 26 to the undeflected state.

The maximum force either edge 12 or 13 of the web 11 can exert against one of the flanges 14 or 15 is dependent upon and limited by the force developed by the spring legs 66 and 40 under deflection due to a helical distortion in the wrap of the web. In essence, the web 11 and the staves 24 and 26 work with one another so that the staves support the web without influencing the lateral position of the web, the lateral position of the web being determined by the flanges 14 and 15. The web in turn positions the staves 24 and 26 axially with respect to axis 28 of the roller 10. The aforedescribed structure is a self-adjusting arrangement for keeping the web 11 from having its edges 12 and 13 damaged by the flanges 14 and 15 of the roller 10.

The entire texts of all applications, patents and publications cited above and below, are hereby incorporated by reference.

From the foregoing description, one skilled in the art can easily ascertain the essential characteristics of this invention, and without departing from the spirit and scope thereof, can make various changes and modifications of the invention to adapt it to various usages and conditions.

We claim:

1. A roller which rotates about an axis as a web of material advances thereover, the roller comprising:

a plurality of axially extending staves having opposite ends and providing a plurality of independent support surfaces for sequentially supporting the web, and resilient constraining means connected to the staves for constraining the staves to motion in only opposite axial directions with respect to the axis of the roller against the bias of the resilient constraining means, said plurality of staves including first staves and second staves arranged around the roller in alternate arrays in which adjacent each first stave there is a second stave, said first and second staves being identical with the first and second staves being staggered axially with respect to one another, wherein the staves each have shoulders adjacent to each end and a land portion disposed between the shoulders wherein the width of the shoulders is substantially less than that of the land portions and wherein the surfaces defined by the shoulders are at a radius with respect to the axis of the roller which is greater than the surfaces defined by the land portions.

2. The roller of claim 1, wherein the roller includes a pair of end flanges positioned outboard of the ends of the staves, the flanges having an inboard surface spaced from the ends of the staves.

3. The roller of claim 2 further including a hollow cylinder rigidly connected to the flanges and positioned beneath the staves.

4. The roller of claim 3, wherein the resilient constraining means comprise first and second sets of spring legs individually secured to the opposite ends of each stave.

5. The roller of claim 4, wherein the spring legs of each set of legs are unitary with and project from separate central portions with spaces between each pair of spring legs, the spring legs of one set being aligned with the spaces between the legs of the other set to allow flexing of the spring legs in the spaces.

6. The roller of claim 5, wherein the central portions are spaced from one another in the direction of the axis of the roller.

7. A roller having a surface over which a web of material advances as the roller rotates, the roller comprising;

a first array of staves having first and second ends, the first array of staves providing first surfaces for supporting the web;

a second array of staves having first and second ends, the second array of staves providing second surfaces for supporting the web;

resilient means for supporting the first and second staves adjacent the ends thereof with the second staves alternating with first staves, wherein the staves individually shift axially against a bias exerted by the resilient means providing a restoring force which compensates for helical winding of the web, and flanges positioned on the roller proximate the first and second ends of the staves to center the web on the roller, whereby the restoring force of the staves minimizes the risk of the edges of the web becoming damaged upon engaging the flanges, said resilient supporting means include means for constraining the staves to motion only in the direction of the roller axis, wherein the staves include central portions and end portions and wherein the end portions are raised with respect to the central portions whereby the web is supported only on the end portions of the staves with minimal contact between the central portions of the staves and the web.

8. The roller of claim 7, wherein the first and second staves are identical, with the first and second staves being staggered axially with respect to one another.

9. The roller of claim 8, wherein the flanges are positioned in spaced relation with respect to the ends of the staves.

* * * * *